US008485686B2

(12) United States Patent
Swan et al.

(10) Patent No.: US 8,485,686 B2
(45) Date of Patent: Jul. 16, 2013

(54) MULTI-SPECTRUM LIGHTING DEVICE WITH PLURALITY OF SWITCHES AND TACTILE FEEDBACK

(75) Inventors: Johnny Swan, Virginia Beach, VA (US); Andrew Borland, Virginia Beach, VA (US); David Rogers, Boston, MA (US); Michael Aaskov, Hampton Falls, NH (US)

(73) Assignee: S & S Precision, LLC, Virginia Beach, VA (US)

( * ) Notice: Subject to any disclaimer, the term of this patent is extended or adjusted under 35 U.S.C. 154(b) by 173 days.

(21) Appl. No.: 13/018,030

(22) Filed: Jan. 31, 2011

(65) Prior Publication Data

US 2011/0249432 A1 Oct. 13, 2011

Related U.S. Application Data

(63) Continuation-in-part of application No. 12/592,327, filed on Nov. 23, 2009.

(60) Provisional application No. 61/199,959, filed on Nov. 21, 2008.

(51) Int. Cl.
*F21V 9/10* (2006.01)

(52) U.S. Cl.
USPC ..... 362/231; 362/205; 362/249.12; 362/184; 362/249.13; 315/320

(58) Field of Classification Search
USPC ..... 362/190, 191, 205, 249.02, 249.05, 362/249.12, 800, 545, 544, 543, 184, 206, 362/231, 249.03, 249.13; 315/313, 320
See application file for complete search history.

(56) References Cited

U.S. PATENT DOCUMENTS

| | | | |
|---|---|---|---|
| 1,107,040 | A | 8/1914 | Conde |
| 1,610,092 | A | 10/1924 | Hise |
| 2,236,736 | A | 9/1938 | Scott |
| 2,296,287 | A | 9/1942 | Leyde |
| 2,346,695 | A | 4/1944 | Miller |
| 2,545,419 | A | 3/1951 | Williams |
| 2,837,630 | A | 6/1958 | Shen |
| 2,972,739 | A | 2/1961 | Opper |
| 3,155,297 | A | 11/1964 | Stumpf |
| 3,348,746 | A | 10/1967 | Stumpf |
| 3,769,663 | A | 11/1973 | Perl |
| 3,834,052 | A | 9/1974 | Steck, III |
| 3,908,950 | A | 9/1975 | Apel |
| 4,008,536 | A | 2/1977 | Adams |
| 4,216,600 | A | 8/1980 | Brueckner et al. |
| 4,777,754 | A | 10/1988 | Reynolds, Jr. |
| 4,905,396 | A | 3/1990 | Bechtel |
| 4,939,863 | A | 7/1990 | Alexander et al. |
| 5,014,892 | A | 5/1991 | Copeland |
| 5,033,219 | A | 7/1991 | Johnson et al. |
| 5,040,322 | A | 8/1991 | Iturrey, Jr. |
| 5,054,170 | A | 10/1991 | Otrusina |
| 5,122,781 | A | 6/1992 | Saubolle |

(Continued)

*Primary Examiner* — Ismael Negron
(74) *Attorney, Agent, or Firm* — Kilpatrick Townsend & Stockton LLP

(57) ABSTRACT

A multi-spectrum emitting device including one or more emitters configured to emit in a first non-visible light spectrum and a second visible light spectrum, and a switching mechanism with at least two switching elements. The switching mechanism is configured to require simultaneous activation of the at least two switching elements in order to change emissions from the first spectrum to the second spectrum. A tactile feedback mechanism is included to provide different tactile feedback for different emission modes of the device.

24 Claims, 7 Drawing Sheets

U.S. PATENT DOCUMENTS 5,203,624 A 4/1993 Schier et al.
5,400,008 A 3/1995 Toohey
5,414,405 A 5/1995 Hogg et al.
5,430,967 A 7/1995 Woodman, III et al.
5,436,814 A 7/1995 Hanley
5,438,494 A 8/1995 Harlan
5,469,346 A 11/1995 Haut et al.
5,620,120 A 4/1997 Tien
5,633,623 A 5/1997 Campman
5,671,561 A 9/1997 Johnson et al.
5,850,954 A 12/1998 Dong-Joo
6,012,827 A 1/2000 Caplan et al.
6,059,156 A 5/2000 Lehtinen
6,067,013 A 5/2000 Pejic
6,069,557 A 5/2000 Anglin, Jr. et al.
6,161,741 A 12/2000 French
6,185,854 B1 2/2001 Solinsky et al.
6,276,088 B1 8/2001 Matthews et al.
6,371,625 B2 4/2002 Campman
6,393,752 B1 5/2002 Oliver et al.
6,478,441 B2 11/2002 Lam
6,499,245 B1 12/2002 Swan
6,578,311 B2 6/2003 Danielson et al.
6,616,294 B1 9/2003 Henry
6,685,067 B2 2/2004 French
6,785,997 B2 9/2004 Oz
6,817,727 B1 11/2004 McFadden
6,955,279 B1 10/2005 Mudd et al.
6,976,777 B1 12/2005 Herold
7,096,620 B2 8/2006 Zeh
7,156,536 B1 1/2007 McCorkle
7,218,241 B2 5/2007 Kessel et al.
7,226,183 B2 6/2007 Galli et al.
7,287,873 B2 10/2007 Galli
7,395,627 B2 7/2008 LaFrance et al.
7,444,776 B2 11/2008 Adams
7,458,489 B1 12/2008 Mudd et al.
7,517,108 B2 4/2009 Galli et al.
7,523,583 B2 4/2009 Cheng
7,562,484 B2 7/2009 Kim
7,694,450 B2 4/2010 Keng
7,735,255 B1 6/2010 Kincaid et al.
7,736,013 B2 6/2010 Griffin
7,743,547 B2 6/2010 Houde-Walter
7,827,724 B1 11/2010 Spinelli
7,836,625 B2 11/2010 Swan et al.
2002/0096545 A1 7/2002 Chang
2002/0148865 A1 10/2002 French
2003/0098323 A1 5/2003 Taylor et al.
2003/0141329 A1 7/2003 Huang
2004/0000083 A1 1/2004 Grant, Jr.
2004/0069821 A1 4/2004 Kobayashi
2006/0026888 A1 2/2006 Cheng et al.
2006/0236583 A1 10/2006 Pikielny
2007/0230162 A1 10/2007 Galli et al.
2008/0205037 A1 8/2008 Griffin
2009/0122527 A1 5/2009 Galli
2009/0185854 A1 7/2009 Adams
2009/0190332 A1 7/2009 Sharrah
2009/0293334 A1 12/2009 Swan
2010/0018103 A1 1/2010 Holmberg
2010/0192448 A1 8/2010 Darian
2011/0032694 A1 2/2011 Swan

MULTI-SPECTRUM LIGHTING DEVICE WITH PLURALITY OF SWITCHES AND TACTILE FEEDBACK

CROSS REFERENCE TO RELATED APPLICATIONS

The present application is a continuation-in-part of U.S. application Ser. No. 12/592,327 filed Nov. 23, 2009 and titled "Illuminating Device and Method," which claims the benefit under 35 U.S.C. §119(e) of U.S. Provisional Application Ser. No. 61/199,959, filed Nov. 21, 2008, the contents of which are hereby incorporated by reference in their entireties.

BACKGROUND OF THE INVENTION

In recent years, the use of lighting devices and detection systems that operate in a variety of spectrums have become increasingly common, particularly in military, and law enforcement operations. For example, in addition to traditional "white light" devices, such as flashlights, military personnel also use colored electrical and chemical lights that emit, or are filtered to, different spectrums within the visible spectrums of light, and non-visible spectrum marking devices and illuminators.

Some of the uses for colored light include reduce visibility lighting and/or compatibility with certain night vision technologies, which can be overwhelmed by white light. Some non-visible spectrum emitters, such as those emitting Medium Wavelength IR (MWIR), Long Wavelength or Far Infrared (LWIR or FIR) light, and Short Wave Infrared (SWIR), may be used in coordination with light-enhancing/intensifying technologies, commonly known as night vision devices (NVDs). For example, infrared lasers or other non-visible illumination sources may be used to "mark" targets for personnel or systems using NVDs by reflecting the infrared or other non-visible light off of the target. In the case of infrared lasers, this can be done from a significant distance from the target. Thus, a soldier marking the target can remain relatively clandestine, without risk of the target illuminator being seen by the naked eye.

When wearing NVDs, users may also employ various non-visible light emitters to act as illumination sources for tasks such as navigation, observation, or other tasks that the user wants improved visibility for while using the NVDs.

The use of NVDs and related illumination devices is also becoming more widespread in commercial markets, such as those related to home defense/security, hunting, private investigation, and even toy and hobby uses, due primarily to the rapid reduction in the cost of NVD technology.

Military units, law enforcement agencies, civil services, and civilians also use strobes and other lights for various purposes such as to identify themselves or injured personnel, hazardous areas, and other objects or places of interest. Depending on the circumstances, or nature of the thing being marked, different lighting functions may be used for such purposes, such as different light spectrums, colors, and/or intensities. As the complexity of the modern battlefield evolves, including the rapid integration of numerous units in smaller areas, clandestine operations in close proximity to enemy units, and more and more operations taking place during hours of darkness, the need for effective marking continues to grow. For example, in certain circumstances all members of a unit may be required to activate and maintain infrared marking devices on their person while on target to allow other units, such as aircraft, etc., to clearly distinguish them from other personnel.

Furthermore, as the access to NVDs and associated emitters becomes more widespread, there is an increasing need for devices with controls that are manageable by ordinary users, who do not have the advanced training of military or law enforcement personnel.

BRIEF SUMMARY OF THE INVENTION

As mentioned above, during military and law enforcement operations, strobe lights, and other marking devices, are utilized to mark friendly forces or areas using visible and non-visible light spectrums. Typically, a non-visible function, such as an IR strobe light, can only be seen by utilizing specialized viewing devices that detect and/or intensify the non-visible light so it can be identified. Other overt signaling and/or marking means, such as white or colored lights, or sound, may also be desirable for emergency situations and the like, where the need to positively identify a hazard or injured person outweighs the need for secrecy.

Currently, there are no known strobes, or similar signaling devices, that have switch mechanisms that can let the user know an emitting mode of the strobe, until the strobe light is already activated. Based on the various circumstances related to the use of IR and other clandestine technologies, if a strobe, or other lighting or signaling device, were accidentally activated incorrectly, such as in a visible light spectrum when an invisible spectrum was needed, it could compromise the user, and present a life-threatening situation to the user and his/her team. Accordingly, there is an ongoing need for improved lighting and/or signaling devices, including lighting and/or signaling devices that ensure positive activation of any overt emission or signal, such as by providing tactile feedback for, and/or combined activation mechanisms that must be activated together in order to force, the overt emissions.

According to aspects of the invention, signaling and/or lighting devices may be provided including a plurality of emitters, and switching mechanisms to change an active emitter. For example, a signaling device may include a non-visible light emitter, a visible light emitter, an inaudible sound emitter, and/or an audible sound emitter, and a switching mechanism that activates the device and/or switches between active emitters. In embodiments, the device may be configured to activate a particular emitter when initially turned on, such as activating the non-visible light emitter. In embodiments, the device may be configured to require simultaneous activation of at least two switching elements in order to change an active emitter. Although exemplary embodiments may be described for convenience and ease of description in the context of, for example, visible and non-visible light emitters, the invention is not necessarily limited to such embodiments and may include emitters and signaling devices of various sorts.

Embodiments may include, for example, a multi-spectrum lighting device including at least one light source. The at least one light source may be configured to emit light in at least a first spectrum and a second spectrum. The first spectrum may be a non-visible spectrum and the second spectrum may be a visible spectrum. Embodiments may include any number of light sources, in any spectrums, including non-visible spectrums and visible spectrums.

Embodiments may include a switching mechanism configured to turn the device on, turn the device off, switch an emitting mode of the device, and combinations thereof. In embodiments, the switching mechanism may include at least two switching elements. The switching mechanism may be configured to require simultaneous activation of the at least two switching elements in order to change an emitted light from the first spectrum to the second spectrum. For example, the switching mechanism may be configured in an arrangement including two opposing switches that can be pressed simultaneously using one hand, e.g. by the thumb and forefinger of the user. In embodiments, at least two switching elements may be positioned on a housing such that at least two forces having different vectors must be applied to activate the at least two switching element. For example, at least two switching elements may be positioned with activation vectors that are 180°, 135°, 90°, 45° opposed from one another, etc.

In embodiments, the switching mechanism may be configured with switching elements located on a housing such than each switching element can not be depressed when the device is pushed against a flat surface of a predetermined size, e.g. the switching elements are not responsive when pushed on by an object with a surface profile that is substantially larger than a human finger, larger than a flat surface with a diameter approximately 1.0 inch or greater, contact surfaces larger than 1.0 inch$^2$, etc. As used herein, when describing force applying objects and surfaces, "contact surfaces" should be understood as those surfaces that exert a force vector with a component in the direction of switch activation when the object is pressed to the switch and/or against the device. For example, in the case of a generally cylindrical force-applying member with a rounded tip, like a human finger, the surfaces of the rounded tip would be considered to be contact surfaces as they exert a force vector with a component in the direction of switch activation when the finger is pressed against the switch in the direction of the switch actuation. On the contrary, the cylinder walls, e.g. the sides of the finger, would generally not be considered to be contact surfaces.

In embodiments, the switching elements may be located on a concave surface of the housing, the concave surface obstructing pressure on the switching element from a flat surface with a diameter greater than a predetermined size. In embodiments, the switching mechanism may be configured with switching elements located on a housing such than each switching element can not be depressed when pushed against a curved surface of a predetermined radius, e.g. the switching elements are not responsive when pushed on by a convex curved surface with a radius of curvature of approximately 1.0 inches or greater, and/or contact surface larger than 1.0 inch$^2$, etc. In embodiments, the switching mechanism may be configured with switching elements located on a housing such than each switching element can not be depressed when pushed against a hemispheric, toric, or irregular surface with protrusions on the surface larger than a predetermined size, e.g. larger than 1.0 inches in diameters, and/or with contact surfaces larger than 1.0 inch$^2$.

According to embodiments, the device may be configured to emit light only in the first spectrum when initially turned on, and to change the emitted light to the second spectrum in response to the switching mechanism. The switching from the first to the second spectrum may be based on, for example, cycling a switching element, or the simultaneous activation of at least two switching elements.

According to embodiments, the at least two switching elements may include a pair of opposing pressure switches, and/or a spectrum switch. The spectrum switch may be configured to activate the changing of an emitted light, or other signal, from the first spectrum to the second spectrum only when the opposing pressure switches are both depressed. In embodiments, the at least two switching elements may be included in a spectrum switch assembly that includes at least two distinct activation mechanisms. For example, the at least two distinct activation mechanisms may include a pressure mechanism and a rotating mechanism in a single assembly.

According to embodiments, the switching mechanism may include a first switching element configured to turn the lighting device on and off.

According to embodiments, the at least one light source may be contained in a housing. In embodiments, the switching mechanism may be mounted to the housing; and an emitted light may be emitted at least partially through the housing. The housing may includes a base configured to mount the device on, and to at least partially conform to, a curved mounting surface. In embodiments, the housing may include a substantially curved emitting surface that extends upwards from the base, and/or extends substantially, or exclusively, inward of the base in plan view. Substantially all of the emitting surface above the base may be configured to allow the emitted light to pass therethrough.

According to other aspects of the invention, a lighting device may be provided with a housing and at least one light source, or other emitter. The at least one light source may be configured to emit light in at least a first spectrum and a second spectrum. Embodiments may also include a switching mechanism configured to turn the device on, turn the device off, switch an emitting mode of the device, and combinations thereof. In embodiments, the switching mechanism may include a plurality of switching elements and/or a feedback mechanism. The switching mechanism may be configured to change an emitted light from the first spectrum to the second spectrum.

In embodiments, the feedback mechanism may be configured to provide a tactile feedback for at least one of when the device is turned on, when the device is turned off, and when a spectrum of emitted light is changed. In embodiments, the feedback mechanism may be configured to provide a first tactile feedback when the device is activated to emit light in the first spectrum and a second tactile feedback, different than the first tactile feedback, when the device is activated to emit light in the second spectrum. In embodiments, the feedback mechanism may be configured to provide tactile feedback while the device is emitting. Any number of different patterns and/or forms of tactile feedback are possible depending on, for example, the number of different emission types, intensities, patterns, etc. Alternatively, embodiments may include tactile feedback for certain emissions, and no tactile feedback for others. For example, an initial, intermittent or sustained tactile feedback may be provided when non-visible, or other emissions that are not discernable by humans without specialized equipment, are activated and/or are being emitted, to alert the user that the device is on.

In embodiments, the feedback mechanism may include a motor within the housing that provides the tactile feedback, such as by rotating an offset wheel or other vibration causing mechanism. In embodiments, the motor may be actuated at different rotating speeds for different active emitters. In embodiments, the device may be configured such that the tactile feedback can be felt through the housing.

According to other aspects of the invention, the at least one light source may be contained in the housing, and/or the switching mechanism may be mounted to the housing, and the emitted light may be emitted at least partially, or substantially, through the housing. In embodiments, approximately 75%, or more, of the housing may be configured as an emitting surface.

In embodiments, the at least one light source may include a plurality of light sources configured to emit light in different spectrums. In embodiments, the at least one light source may include at least one of a visible light emitter, a non-visible light emitter, a visible laser emitter, a non-visible laser emitter and combinations thereof. According to embodiments, the light emitting diode(s) may be completely encapsulated within the housing. In embodiments, the at least one light source may include a light emitting diode and associated controls capable of programming to allow illumination of the lighting device in different colors by manipulation of the switching mechanism.

In embodiments, the housing, and/or base, may include one or more apertures disposed through the housing/base to attach the device to a mounting surface. The housing and/or base may include one or more clipping mechanisms, e.g. disposed on the housing, and/or base, to attach the device to a mounting surface.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention claimed. The detailed description and the specific examples, however, indicate only preferred embodiments of the invention. Various changes and modifications within the spirit and scope of the invention will become apparent to those skilled in the art from this detailed description.

BRIEF DESCRIPTION OF THE DRAWINGS

The accompanying drawings, which are included to provide a further understanding of the invention, are incorporated in and constitute a part of this specification, illustrate embodiments of the invention and together with the detailed description serve to explain the principles of the invention. No attempt is made to show structural details of the invention in more detail than may be necessary for a fundamental understanding of the invention and various ways in which it may be practiced. In the drawings.

DETAILED DESCRIPTION OF THE INVENTION

Figure 1:
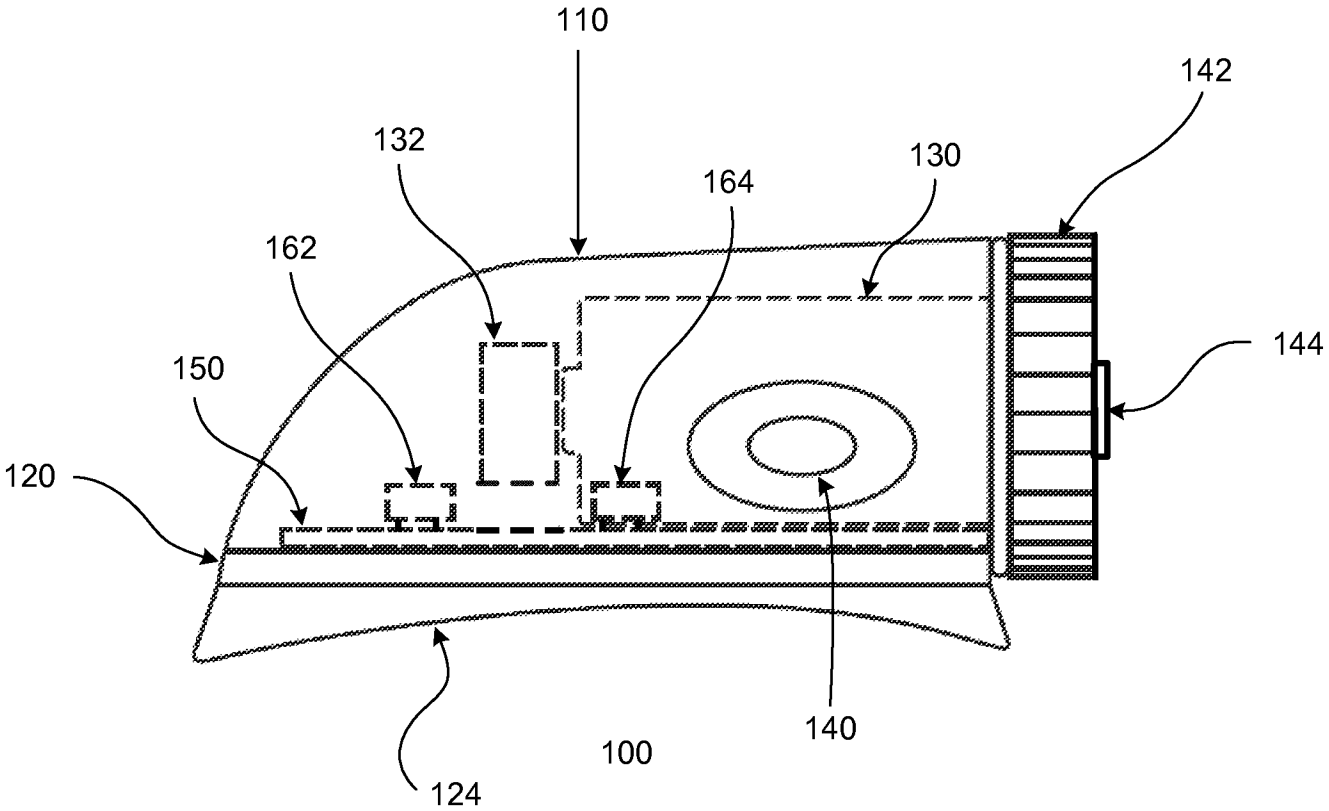
FIG. 1 is a schematic side view, including interior details, of a first embodiment of an exemplary strobe lighting device according to the principles of the invention.

It is understood that the invention is not limited to the specific exemplary arrangements, configurations, etc., described herein, as these may vary as the skilled artisan will recognize. It is also to be understood that the terminology used herein is used for the purpose of describing particular embodiments only, and is not intended to limit the scope of the invention. It also is be noted that as used herein and in the appended claims, the singular forms "a," "an," and "the" include the plural reference unless the context clearly dictates otherwise. Thus, for example, a reference to "an emitter" is a reference to one or more emitter and equivalents thereof known to those skilled in the art.

Unless defined otherwise, all technical and scientific terms used herein have the same meanings as commonly understood by one of ordinary skill in the art to which the invention pertains. The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals reference similar parts throughout the several views of the drawings.

Moreover, provided immediately below is a "Definition" section, where certain terms related to the invention are defined specifically. Particular components, devices, and materials are described, although any components and materials similar or equivalent to those described herein can be used in the practice or testing of the invention. All references referred to herein are incorporated by reference herein in their entirety.

The term "visible spectrum" as used herein refers to electromagnetic radiation of a spectrum that is discernable by the human eye, and may include ranges around 400-790 THz. The term "non-visible spectrum" as used herein refers to electromagnetic radiation of a spectrum that is not discernable by the human eye, including, for example, short wave infrared (SWIR), the near infrared (NIR) the Medium Wavelength IR (MWIR), Long Wavelength or Far Infrared (LWIR or FIR), or ultraviolet spectrums, as well as other electromagnetic spectrums that may be used as illumination for specialized detectors and the like.

The term "lighting source" as used herein may refer to various types of emitters, including those that emit light, and other detectable waves, in visible and non-visible spectrums. Lighting sources may include, for example, all manner of electrically powered, chemical, and organic sources of various detectable radiation.

The following preferred embodiments may be described in the context of exemplary lighting devices for ease of description and understanding. However, the invention is not limited to the specifically described devices and methods, and may be adapted to various apparatus without departing from the overall scope of the invention.

Figure 2:
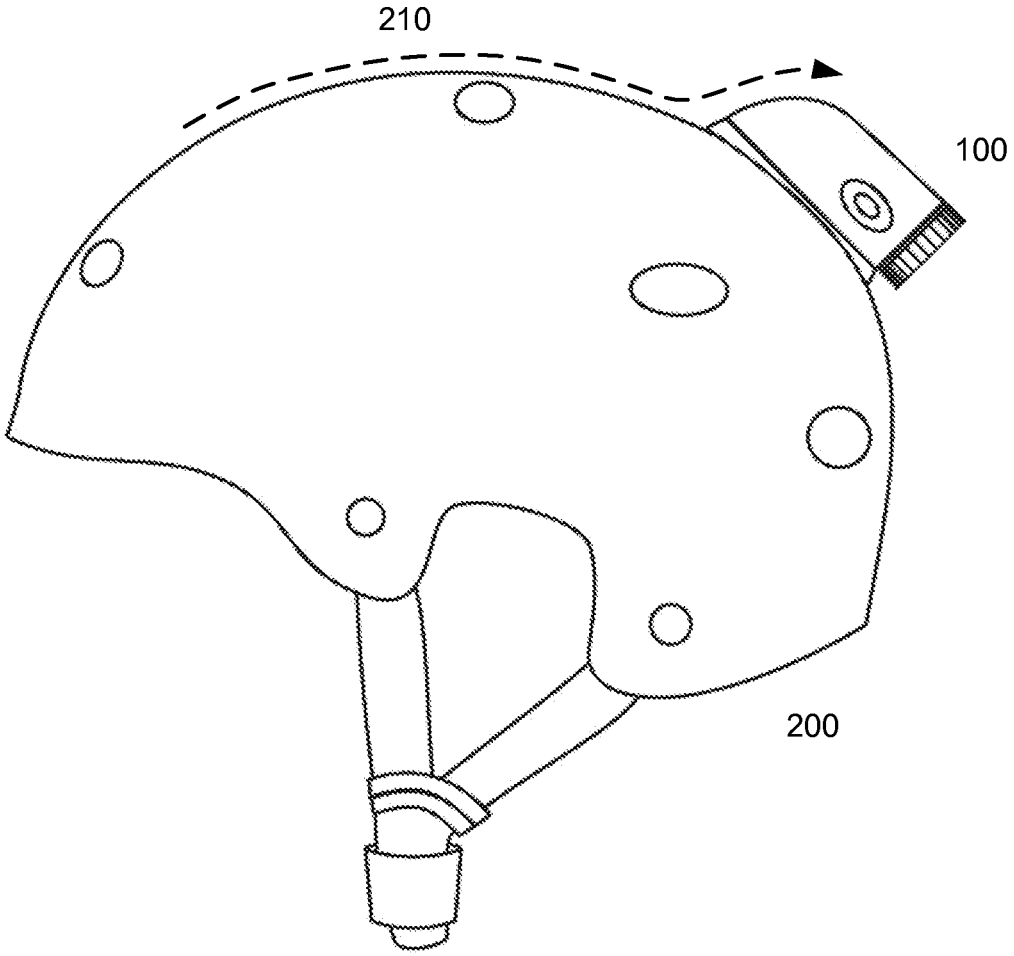
FIG. 2 is a side view of an exemplary strobe lighting device as shown in FIG. 1, mounted on a curved surface of a helmet.

As shown in FIG. 1, a first embodiment of the invention may include a strobe lighting device 100, including a housing 110. The housing 110 may be formed of, or attached to, a base 120 and rounded mounting surface 124. In embodiments, base 120 and mounting surface 124 may be separately formed, or formed together from a single piece of material. As described further below, mounting surface 124 may be advantageously curved, with one or more radii of curvature, in order to, for example, fit closely with a corresponding convex surface, such as a helmet or the like, as shown in FIG. 2. Such close fitting configurations may be advantageous in reducing the likelihood of snagging the strobe device 100, or the like, when worn on curved equipment, helmets, etc., and can be particularly useful in the context of parachuting and other activities where chords, which may have a small diameter, are drawn along and/or over the helmet, such as in direction 210 in FIG. 2, or other equipment to which the device is mounted.

According to aspects of the invention, various lighting, and other signaling devices, may include a shaped mounting surface, e.g. a side which is opposing an exterior surface of the device, that is hemispherical or toric to provide mating with a corresponding hemispherical/toric shape of a helmet such that there are substantially no gaps between the mating edges of the lighting device and the helmet. The device 100 may be capable of being attached to various surfaces using one or more fasteners such as one or more hook and loop fasteners. For example, with a precut piece of nylon hook or loop material, which may generally match the shape of the profile of the device 100, the device 100 may be operatively attached to the curved surface of a tactical ballistic helmet, parachuting helmet, or other helmet 200, as shown in FIG. 2. This application may be particularly useful in overcoming challenges in providing illumination along and around a convex compound-curved surface. Such attachment means and method may permit, for example, the secure, but removable, attachment of the device 100 to the back of a parachutist's helmet, limiting the chance of the light becoming a snag hazard for the parachutist, and allowing for a quick transition to other helmets, such as ballistic helmets, that may be required.

Figure 3:
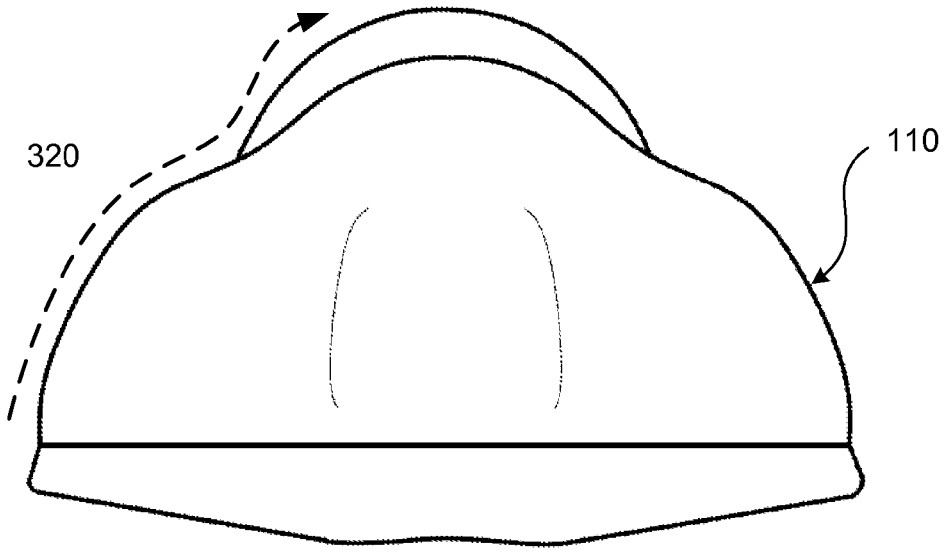
FIG. 3 is a front view, including exterior details, of the exemplary strobe lighting device shown in FIG. 1.
Figure 4:
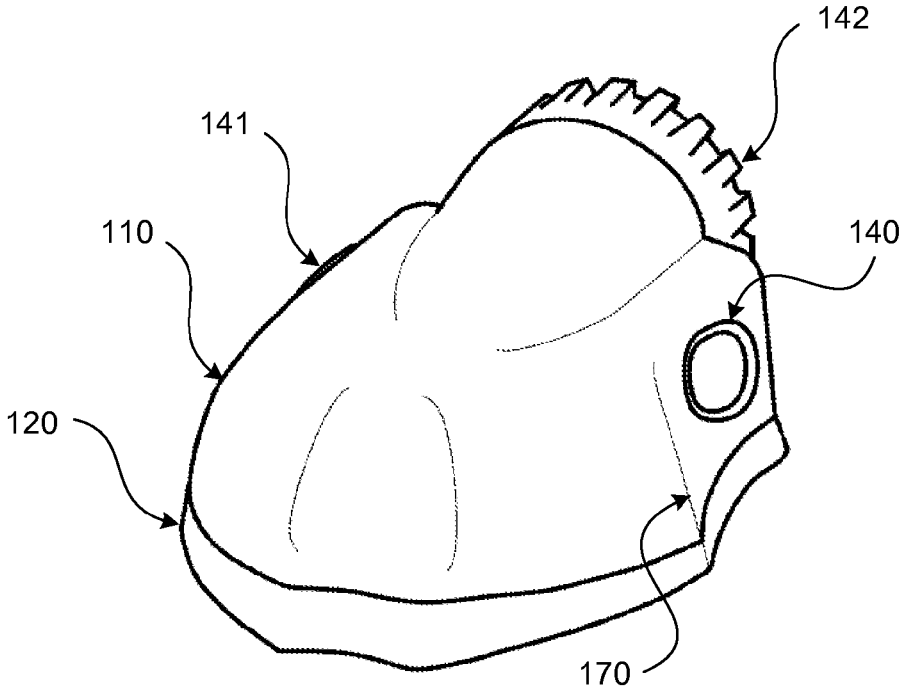
FIG. 4 is an isometric top view, including exterior details, of the exemplary strobe lighting device shown in FIG. 1.

As also shown in FIGS. 1-4, the housing 110 may be substantially curved and/or sloped away from the outer perimeter of the base 120 throughout a majority of the outer surface or emitting surface, e.g. the device may be generally convex with respect to the base. According to aspects of the invention, the device 110, and the like, may maintain a substantially convex shape with respect to the base, such as shown in FIG. 3, while also having concavities, such as concavity 170. The inclusion of such features is discussed in detail further below and may be advantageous, for example, for disposition of switches 140, 141, etc. Such curvatures and/or slopes of the housing may also help to reduce the snag hazards associated with other strobe and lighting designs, such as those presenting perpendicular surfaces, or overhangs, when mounted to a surface. For example, a chord or other object being dragged in the direction 320, shown in FIG. 3 along the exterior of the housing 110, will not meet with any overhangs, or sharply angled corners on which the object would be prone to snag. The convex shape of the housing 110 is also important when worn on top of a helmet, further reducing the possibility of something snagging the strobe, or other device, and causing neck injuries to the user. In cases where some non-emitting surfaces, such as a removable cap 142, may present one or more non-rounded edges, aspects of the invention may compensate for these by, for example, angling all or parts of the surrounding surface of the housing 110 away from the non-rounded portion, as well as disposing the non-rounded portion at a posterior of the device, such that it does not routinely make first contact with objects when the user is moving in a forward direction.

It should be noted that, various emitting surfaces described herein may typically include the exterior of a housing, but may not necessarily include the base, removable caps, etc., which may be formed from non-transparent materials in certain embodiments.

Returning to FIG. 1, a power source 130, and a motor 132, such as an electric motor, may be contained within the housing 110, and attached to control circuitry on a circuit board 150. The motor 132 may include a shaft (not shown) attached to a rotating wheel, or other vibrating mechanism. In embodiments, the wheel may be, for example, offset, or unequally weighted, to induce vibration that can be felt through the housing 110 when the wheel is rotated. The motor 132 may be controlled in various ways to create different vibration patterns, such as intermittently running the motor, running the motor at different speeds, etc.

Thus, one or more motors 132 or other vibrating mechanisms known to those skilled in the art may be electrically connected to circuit board 150 to allow a user to determine whether the device 100 is activated, e.g. illuminated, without requiring visual inspection of the device 100. With the motor 132, or other vibrating device, etc., the user may determine whether the device 100 is activated or deactivated or what emitting mode, pattern, or sequence of activation in which the device 100 is operating by touch rather than visual inspection. The motor 132, or other vibrating device, may vibrate when the device 100 is activated in a first mode and may either not vibrate, or vibrate in a different vibration pattern or sequence, when the device is deactivated, or activated in a second mode.

For example, when the device is turned on is a first operating mode, a first vibration pattern, such as repeating short vibrations, may be produced by the motor and vibration mechanism, and, when the device is switched to a second operating mode, a second vibration pattern may be produced, such as by a pattern of short and long vibrations. In embodiments, the first operating mode may be, for example, a non-visible light emitting mode, and the second operating mode may be, for example, a visible light emitting mode.

In another example, the device may be turned on, such as by pressure switch 144, or the like, in a first non-visible operating mode, that may be a short-range IR mode, e.g. emitting at approximately 930-960 nm. Such emissions may be beneficial, for example, for short-range detection of local ground units. A first vibration pattern may be produced by the motor and vibration mechanism to alert the user that the device is emitting in the first non-visible operating mode. Consequently, the switch may be activated again to switch from the first non-visible operating mode to a second non-visible operating mode, that may be a mid to long-range IR mode, e.g. emitting at approximately 820-875 nm. Such emissions may be beneficial, for example, for mid to long-range detection of ground units by air assets or other vehicles. A second vibration pattern may be produced by the motor and vibration mechanism to alert the user that the device is emitting in the second non-visible operating mode. Consequently, the switch may be activated again to switch from the second non-visible operating mode to a visible operating mode. When the device is switched to the visible operating mode, a third vibration pattern may be produced to alert the user that the device is emitting in the visible operating mode. At any time after the device is powered on by the switching mechanism, the user may turn the device off, by the same, or different, switching element, which may reset the cycle of emitting modes back to the first non-visible operating mode. In other embodiments, the first non-visible operating mode may be a relatively low-power emitting mode and the second non-visible operating mode may be a relatively high-power emitting mode, with a higher emitting power in the same, or different, spectrum than the first non-visible operating mode. A rotary switch, and the like, may also be used to switch between various operating modes, with, or without, dependence on another switching element to activate the rotary switch or the like.

The tactile feedback, such as provided by motor 132 or the like, may be felt through the housing 110, and may be especially useful when the device 100 is disposed on a helmet or other equipment on the user's body. The tactile feedback may, for example, give a user, such as a soldier, parachutist, rescue worker, or other helmeted individual, positive feedback whenever the device 100 is activated, deactivated, or changed operating modes, atop the user's helmet.

The device 100 may further include switches 140, 142, and 144 on the housing 110, and electrically connected with the control circuitry on the circuit board 150. In embodiments, switch 140 may be configured as a pressure switch, and, as described further below, may be configured to operate in coordination with another switch 141, shown in FIG. 3, on the opposite side of the housing 110. In embodiments, switch 142 may be a rotating switch, or may be a removable cap and/or housing for a pressure switch 144. Pressure switch 144 may be configured as an "on/off" switch for powering the device on and off. Rotating switch/cap 142 may be configured as a mode switching switch, changing, for example, operating modes of the device. In embodiments, either or both of switches 142 and 144 may be configured to be operable only when the switch 140 and the opposing switch 141 are activated, i.e. while both of switches 140 and 141 are pressed inward. For example, the device and/or included switching mechanisms, may be configured such that the control circuit of the device only responds to the switches 142 and 144 when switches 140 and 141 are simultaneously activated, or simultaneously activated for a predetermined time. In other embodiments, switches 140 and 141 may act together as an independent switching mechanism, such as an on/off switch or a mode switching switch. For example, when configured as an on/off switch, the switches 140 and 141 may be configured such that the device 100 is only turned on when the switches 140 and 141 are activated simultaneously for a predetermined period of time, e.g. 0.5 seconds, 1.0 seconds, etc. Similarly, rotating switch 142, or the like, may be configured to be operable only when the pressure switch 144 is depressed.

In embodiments, the pressure switch 144 may be configured as an on/off switch that turns the device on in a first preprogrammed light spectrum, e.g. a non-visible spectrum. The pressure switch 144 may be configured as a "powerless" switch that has no current running through it when it is not being actuated. Such configurations may be advantageous, for example, in preventing damaging short circuiting of the device due to environmental factors and the like, which can be problematic with exterior switches, and particularly with switches that may be disposed on removable portions of the device, such as removable switch/cap 142.

As mentioned previously, turning the device on in a first operating mode may cause a tactile feedback mechanism to provide a vibrating or other indication that the device is on and operating in a particular mode. Therefore, if the operator turns the device on, but receives no tactile feedback, or an incorrect tactile feedback, the user can be alerted to a problem immediately, even if they do not have NVD's or other equipment to detect the non-visible or covert emission. In other embodiments, the user may turn the device 100 on in, or switch to, a different operating mode, such as a visible light spectrum, by depressing switches 140 and 141 and/or activating the switch 144.

Figure 5:
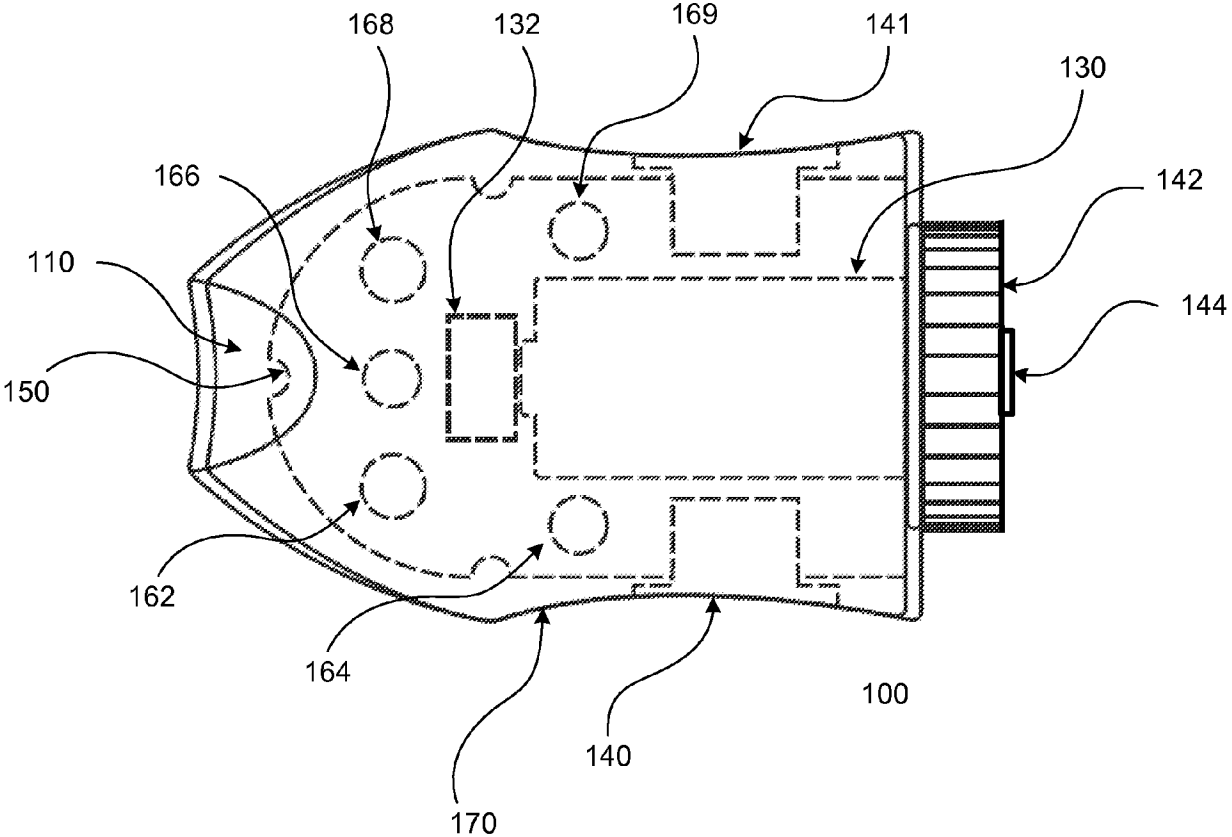
FIG. 5 is a schematic top view, including interior details, of the exemplary strobe lighting device shown in FIG. 1.

As shown in FIG. 5, the switches 140, 141 may be configured in an arrangement of two opposing switches that can be pressed simultaneously using one hand, e.g. by the thumb and forefinger of the user. In embodiments, at least two switching elements, similar to switches 140, 141, may be positioned on a housing such that at least two forces having different vectors must be applied to activate the at least two switching element. In the case of switches 140, 141, the force vectors are directly opposed, i.e. 180°. In other embodiments, at least two switching elements may be positioned with activation vectors that are, for example, 135°, 90°, or 45° opposed from one another, etc.

The device 100 may be configured to provide a tactile feedback when the switches 140 and 141 are activated together for a predetermined period of time, thereby changing an emitting mode, or allowing activation of the switch 144 to change the emitting mode. For example, the user may depress switches 140 and 141 together simultaneously for 0.5 seconds, at which time, the device provides a tactile feedback and may, for example, change an emitting mode of the device, or allow the switch 144 to change the emitting mode of the device.

In embodiments where the device does not automatically switch to another emitting mode after switches 140 and 141 are activated together simultaneously, the device may be configured to maintain the switch 144 in an operable state for a predetermined amount of time following the activation, e.g. for 3.0 seconds after activation. The device 100 may be configured to continue to provide tactile feedback during the time the switch 144 is maintained in the operable state, and to cancel the tactile feedback either (1) when the switch 144 is depressed/activated, or (2) the predetermined time expires. If the switch 144 is activated while in the operable state, the tactile feedback pattern may be changed to alert the user that the device has successfully changed modes. This may be advantageous, for example, when the user is not able to appreciate the change in modes through their other senses, such as when the user is unable to see the device mounted on their helmet etc., and/or when the user is wearing NVD's and the device changes from IR to visible light, or switches colors of visible light.

In embodiments, to further reduce the possibility of activating the device in the visible light spectrum, or other overt emission spectrums, the device 100 may be configured to only turn on in the non-visible light spectrum, or other covert emission spectrum, when initially powered on, regardless of the activation of switches 140, 141 and the like.

Switching elements 140, 141 may be further configured, for example, by arranging and thermally, or chemically, bonding two dissimilar materials together such that they create a barrier from the battery contacts and the outside environment. One of the materials may be substantially more rigid than the second material, e.g. to provide enough structure to support the switching elements which are connected to it. The second material may be more flexible than the first material, e.g. to allow depression of the switching elements on one side of it.

In embodiments, the housing 110 may be configured to be partially, substantially, or completely translucent, thereby the body of the device 100 to act as a medium for the different light spectrums to pass through. Therefore, in embodiments where, for example, substantially all of the housing is configured to be translucent, the device may provide illumination from the majority of the housing surface. Such features may be advantageous, for example, to allow a maximum illumination in a relatively low profile shape.

Circuit board 150 is disposed within the housing 110 and may be secured at a location within the housing 110 and encapsulated completely, or at least substantially, within the housing 110 and base 120. The circuit board 150 may be a printed circuit board "PCB" having multiple components electrically connected thereto. The housing 110 may be constructed such that the conductive leads which connect electrical current from the battery (not shown) to the circuit board 150, emitters, motor(s) and/or switches are injection molded inside, e.g. through, a surrounding material that protects the circuit board 150 from the outside environment. For example, the housing may be substantially waterproof when secured or bonded to the base 120/124, and accessible from the outside elements only via a battery compartment surrounding power source 130 through removable switch/cap 142. The electrical leads to the battery may be injection molded into the housing 110 thereby sealing the remainder of the working components in the housing 110 from the outside, even when the battery compartment is opened. This design construction and manufacturing process thereby protects the circuit board from being damaged or electrically "shorted" in the event that conductive or harmful materials are allowed to enter the battery compartment when a battery compartment cap, such as switch/cap 142, is removed or damaged.

As shown in FIGS. 1 and 5, a plurality of emitters 162, 164, 166, 168, 169 may be electrically connected to the circuit board 150. Emitters 162, 164, 166, 168, 169 may include one or more single-color LEDs, one or more multi-color LEDs, one or more non-visible LEDs, and/or various types of other emitters including, for example, sound or radio emitters including encrypted and/or unencrypted signals.

The emitters 162, 164, 166, 168, 169 may be programmed to, for example, illuminate in multiple visible colors (e.g., four colors) with one or more LEDs within one device 100. A particular color of the multiple colors may be selected by activating the switch 142, giving the user the capability of activating multiple illumination colors with one device.

In embodiments, emitters 162, 168 may be a first spectrum emitters, e.g. FIR emitters, emitters 164, 169 may be second spectrum emitters, e.g. one or more visible color emitters, and emitter 166 may be a third spectrum emitter, e.g. an SWIR emitter. Thus, devices according to aspects of the invention may operate in various spectrums including one or more spectrums in the non-visible spectrums. This may be advantageous, for example, in providing even more difficult to distinguish emissions for clandestine operations, such as near infrared (NIR) to the shortwave infrared (SWIR) portions of the light spectrum, which are beyond what traditional night vision goggles can see. The tactile feedback features described herein may be particularly useful in such cases where individual users may not have the capability to see the emitted spectrum, which may be seen by air platforms or other specialized receivers. In some cases NIR/SWIR cameras may be configured to see light wavelengths from 0.7 micrometers (μm) to 1.7 μm, whereas traditional NVDs can detect wavelengths up to roughly 1.0 μm. Although described in the context of visible and non-visible light emitters, such as LEDs, it should be understood that various types of other emitters are contemplated as within the scope of the invention, including various sound and radio emitters, which may also include encrypted and unencrypted transmissions, etc.

The lighting sequence(s) of the device 100 may be controlled by a microcontroller or microprocessor which is operatively attached to the circuit board 150. The firmware of the microcontroller or microprocessor may be programmed via software. The firmware may control such functions as, for example, mode switching sequences, LED blink patterns, rate, and/or intensity, LED color patterns, timed shut down sequences, and a variety of other user-specific functions.

The device 100 may include various attachment mechanisms, and/or a curved mounting surface 124, configured to allow for different attachment methods onto ballistic/non-ballistic helmets, tactical vest, armor carriers and vehicles. The attachment means, members, and methods described below are merely examples and are not limiting of attachment means, methods, and members of the device 100 to any surface or object. Rather, any attachment means, method, or member of attaching a device 100 to an object, surface, material, or piece of equipment is within the scope of embodiments.

Figure 6:
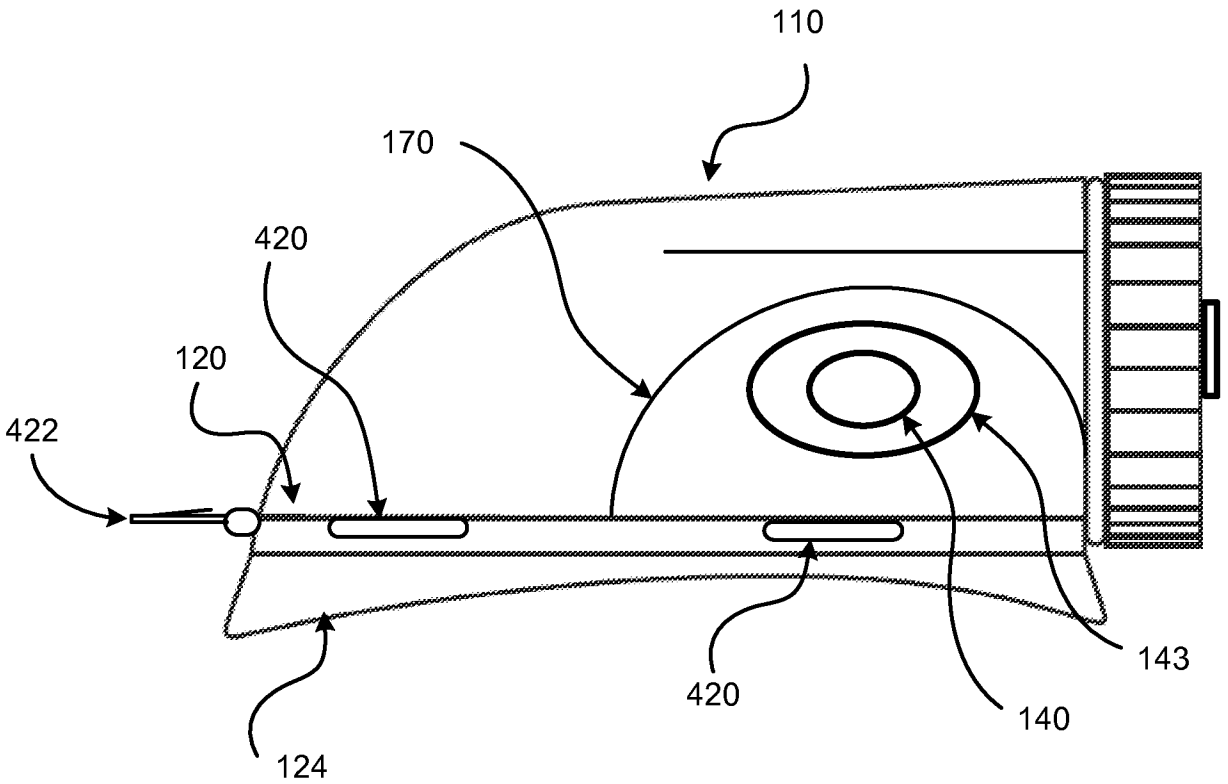
FIG. 6 is a side view of an exemplary strobe lighting device including further details of an exemplary housing according to aspects of the invention.

As shown in FIG. 6, the base plate 120 can have a curved mounting surface 124 which allows the device to be mounted directly to the curved surface of a helmet using, for example, hook and loop fasteners, adhesive tape, epoxy, or a variety of metal and plastic fasteners. The base plate 120 can have through holes 420 and slot features that allow the invention to be attached with lanyards, flat webbing material or fasteners. The base plate may also have male/female receiving features, such as attachment clip 422, which allow the device to releasably-lock into an opposing and/or receiving mechanism respectively. Such features may be advantageous, for example, in enabling the device 100 to be attached quickly to a piece of gear, and to be removed quickly from the piece of gear and attached to another.

As also shown in FIG. 6, the housing 110 may be formed to further protect the device 100 from accidental activation. For example, the housing 110 may include concave features 170 around switches 140, 141. Additionally, the switches 140, 141 may be formed with rigid surrounds 143 that limit the responsiveness of the switches to large objects being pressed against them. For example, the concavities 170, and/or rigid surrounds 143 may be shaped and/or formed from a material that prevents, for example, the switches 140, 141 from being activated by surfaces of greater than a predetermined size/profile. That is, pressure switches, and the like, may resist being depressed when the device is pushed against a surface of a predetermined size and/or profile, e.g. the switching elements are not responsive when pushed on by a flat surface with a diameter approximately 1.0 inch or greater, or a curved surface with a radius of curvature of approximately 1.0 inches or greater, and/or objects with contact surfaces greater than 1.0 inches$^2$. In embodiments where one or more of the switching elements are disposed on a concave surface of the housing, the concave surface may obstruct pressure on the switching element from a flat surface with a diameter greater than a predetermined size.

In embodiments, the switching elements, such as 140, 141, may be located on the housing 110 such than each switching element can not be depressed when pushed against a curved surface of a predetermined radius, e.g. the switching elements are not responsive when pushed on by a convex curved surface with a radius of curvature of approximately 1.0 inches or greater, or approximately 2.0 inches or greater. In embodiments the switching elements, such as 140, 141, may be located on the housing 110 such than each switching element can not be depressed when pushed against a hemispheric, toric, or irregular surface with protrusions on the surface larger than a predetermined size, e.g. larger than 2.0 inches, and/or with contact surfaces greater than 1.0 inches$^2$. Such features may be achieved, for example, by appropriately sizing and/or shaping the concavities 170 and/or sizing the rigid surrounds 143. In embodiments, the switches 140, 141 may be configured to respond only to pressure from an object that is substantially the same size, or smaller, than a human finger.

Figure 7A:
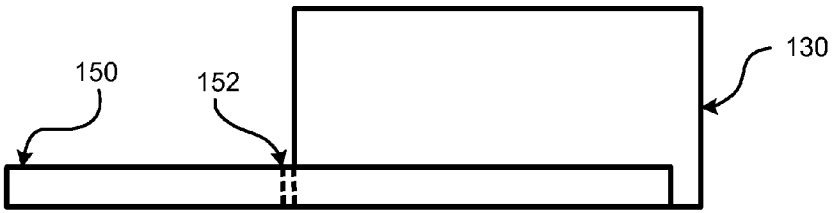
FIGS. 7A and 7B depict a side and top view, respectively, of an exemplary circuit board and power source according to aspects of the invention.
Figure 7B:
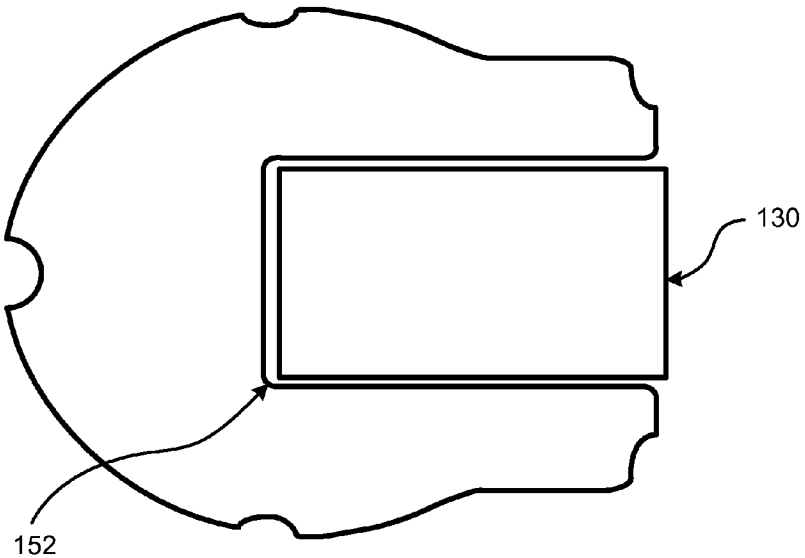

The device 100 may include one or more power sources 130, such as one or more batteries, electrically connected to the circuit board 150 to power the electronic components of the device 100. In one embodiment shown in FIGS. 7A and 7B, the power source 130 may penetrate the circuit board 150 so that an overall height of the device may be reduced. For example, a power source 130, such as a battery, may be an elongated cylinder, with a diameter less than a length of the cylinder. The power source 130 thus may be (1) arranged such that the relatively small diameter of the cylinder is arranged in the same direction as the relatively small height of the circuit board 150, and/or (2) positioned within a cutout 152 to accommodate the power source even lower in the device as shown in FIGS. 7A and 7B. Other configuration, such as power sources being shaped as rectangular solids, short cylinders, etc. are also contemplated, in which a relatively small dimension of the power source is arranged in the same direction as the relatively small height of the circuit board. Accordingly, a lighting device, and the like, may be constructed by wrapping the circuit board at least partially around the battery, or other power source, such as in a horseshow shape as shown in FIG. 7B, or other shapes in which the battery is inset with, or penetrates the circuit board. In preferred embodiments, this may include neither element being stacked on top of the other, in a manner whereby the overall height of the combined power source and circuit board does not exceed a maximum height of either of the individual components.

Figure 8:
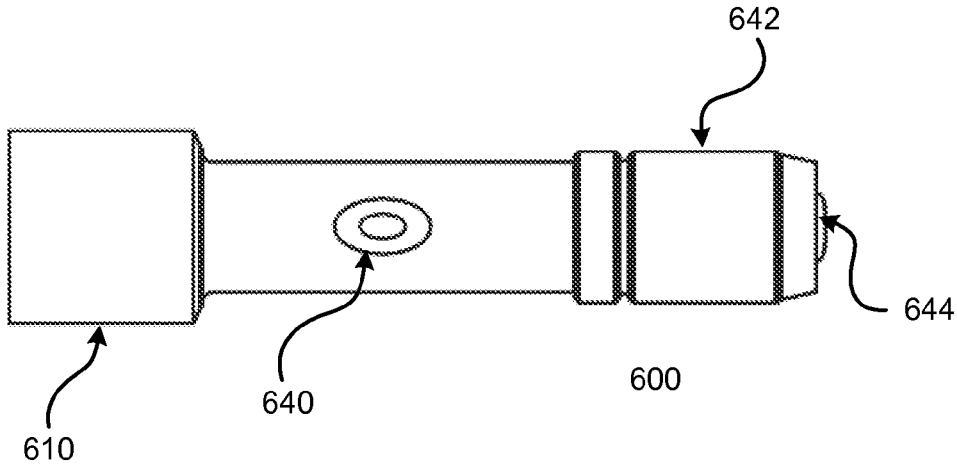
FIG. 8 depicts another embodiment of an exemplary lighting device according to aspects of the invention.
Figure 9:
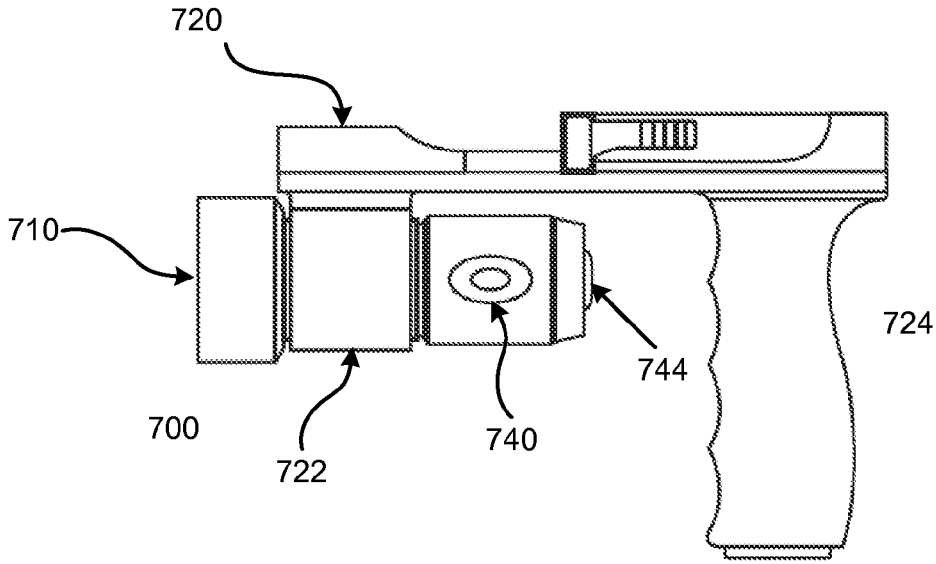
FIG. 9 depicts yet another embodiment of an exemplary lighting device, included in a rail-mount system, according to aspects of the invention.

FIG. 8 depicts another embodiment according to aspects of the invention including a lighting device 600. The lighting device 600 may be configured to operate in a manner similar to that described above with respect to device 100. For example, lighting device 600 may include an emitting end 610 containing a plurality of emitters (not shown) such as IR laser, visible laser, IR LEDs, and/or visible light LEDs.

Lighting device 600 may include one or more of switches 640 and/or 644. Switch 640 may have an opposing switch (not shown) similar to the arrangement of switches 140, 141 in FIG. 5. Accordingly, the lighting device 600 may require simultaneous activation of switch 640 and its opposing switch in order to activate the lighting device 600 and/or switch an operating mode of the lighting device 600, e.g. between non-visible and visible spectrums.

In embodiments, switch 644 may be configured as an on/off switch or a mode switching switch. Switch 644 may be independently operable, or dependent on operation of switch 640 and its opposing switch. Thus, switch 644 may require simultaneous activation of switch 640 and its opposing switch in order to activate the lighting device 600 and/or switch an operating mode of the lighting device 600, e.g. between non-visible and visible spectrums.

A vibrating element, or other tactile feedback device, may be contained in end 642, and operate in similar manner to the motor 132 described above. For example, lighting device 600 may include a tactile feedback device that activates when the lighting device 600 is activated, and/or changed from one operating mode to another.

FIG. 8 depicts another embodiment according to aspects of the invention including a lighting device 700 attached to a rail system 720, such as used on various assault weapons. The lighting device 700 may be configured to operate in a manner similar to that described above with respect to device 100. For example, lighting device 700 may include an emitting end 710 containing a plurality of emitters (not shown) such as IR laser, visible laser, IR LEDs, and/or visible light LEDs.

Lighting device 700 may include one or more of switches 740 and/or 744. Switch 740 may have an opposing switch (not shown) similar to the arrangement of switches 140, 141 in FIG. 5. Accordingly, the lighting device 700 may require simultaneous activation of switch 740 and its opposing switch in order to activate the lighting device 700 and/or switch an operating mode of the lighting device 700, e.g. between non-visible and visible spectrums.

In embodiments, switch 744 may be configured as an on/off switch or a mode switching switch. Switch 744 may be independently operable, or may be dependent on operation of switch 740 and its opposing switch. Thus, switch 744 may require simultaneous activation of switch 740 and its opposing switch in order to activate the lighting device 700 and/or switch an operating mode of the lighting device 700, e.g. between non-visible and visible spectrums. In embodiments, the lighting device 700 may include various visible and non-visible laser emitters that can be used as rapid sighting devices for a weapon that the rail system 720 is attached.

A vibrating element, or other tactile feedback device, may be contained in the device 700, and operate in similar manner to the motor 132 described above. For example, lighting device 700 may include a tactile feedback device that activates when the lighting device 700 is activated, and/or changed from one operating mode to another. The feedback device may be configured to transmit tactile feedback through the mounting ring 722 and to the foregrip 724 such that the user can easily detect the vibration as long as the foregrip is being held by the user.

The description given above is merely illustrative and is not meant to be an exhaustive list of all possible embodiments, applications or modifications of the invention. Thus, various modifications and variations of the described methods and systems of the invention will be apparent to those skilled in the art without departing from the scope and spirit of the invention. Although the invention has been described in connection with specific embodiments, it should be understood that the invention as claimed should not be unduly limited to such specific embodiments.

What is claimed is:

1. A multi-spectrum lighting device comprising:

at least one light source, the at least one light source configured to emit light in at least a first spectrum and a second spectrum;

a switching mechanism including at least two switching elements; and a feedback mechanism, wherein, the switching mechanism is configured to turn the lighting device on and off, to change an emitted light from the first spectrum to the second spectrum, and to require simultaneous activation of the at least two switching elements in order to change an emitted light from the first spectrum to the second spectrum, the feedback mechanism is configured to provide a tactile feedback for at least one of when the device is turned on, when the device is turned off, and when a spectrum of emitted light is changed, and the feedback mechanism is configured to provide a first tactile feedback when the device is activated to emit light in the first spectrum and a second tactile feedback, different than the first tactile feedback, when the device is activated to emit light in the second spectrum.

2. The lighting device of claim 1, wherein the at least two switching elements includes a pair of opposing pressure switches, and a spectrum switch, the spectrum switch configured to activate the changing of an emitted light from the first spectrum to the second spectrum only when the opposing pressure switches are both depressed.

3. The lighting device of claim 1, wherein the switching mechanism includes a first switching element configured to turn the lighting device on and off.

4. The lighting device of claim 1, wherein the first spectrum is a non-visible spectrum and the second spectrum is a visible spectrum.

5. The lighting device of claim 4, wherein the device is further configured to emit light only in the first spectrum when initially turned on, and to change the emitted light to the second spectrum, while the device is turned on, based on the simultaneous activation of the at least two switching elements.

6. The lighting device of claim 1, wherein the at least two switching elements are included in a spectrum switch assembly that includes at least two distinct activation mechanisms.

7. The lighting device of claim 6, wherein the at least two distinct activation mechanisms include a pressure mechanism and a rotating mechanism.

8. The lighting device of claim 1, further comprising a housing, wherein:

the at least one light source is contained in the housing;

the switching mechanism is mounted to the housing; and the emitted light is emitted at least partially through the housing.

9. The lighting device of claim 8, wherein the housing includes:

a base configured to mount the device on, and at least partially conform to, a curved mounting surface; and a substantially curved emitting surface that extends upwards from the base, substantially all of the emitting surface above the base configured to allow the emitted light to pass therethrough.

10. A multi-spectrum lighting device comprising:

a housing;

at least one light source, the at least one light source configured to emit light in at least a first spectrum and a second spectrum;

a switching mechanism including a plurality of switching elements; and a feedback mechanism;

wherein, the switching mechanism is configured to turn the lighting device on and off, and to change an emitted light from the first spectrum to the second spectrum, the feedback mechanism is configured to provide a tactile feedback for at least one of when the device is turned on, when the device is turned off, and when a spectrum of emitted light is changed, and wherein the feedback mechanism is configured to provide a first tactile feedback when the device is activated to emit light in the first spectrum and a second tactile feedback, different than the first tactile feedback, when the device is activated to emit light in the second spectrum.

11. The lighting device of claim 10, wherein the switching mechanism includes a first switching element configured to turn the lighting device on and off.

12. The lighting device of claim 10, wherein the tactile feedback is provided by a motor within the housing, and can be felt through the housing.

13. The lighting device of claim 10, wherein the first spectrum is a non-visible spectrum and the second spectrum is a visible spectrum.

14. The lighting device of claim 10, wherein the device is further configured to emit light only in the first spectrum when initially turned on, and to change the emitted light to the second spectrum, while the device is turned on, based on activation of the switching mechanism.

15. The lighting device of claim 10, wherein:

the at least one light source is contained in the housing;

the switching mechanism is mounted to the housing; and the emitted light is emitted at least partially through the housing.

16. The lighting device of claim 10, wherein the housing includes:

a base configured to mount the device on, and at least partially conform to, a curved mounting surface; and a substantially curved emitting surface that extends upwards from the base, substantially all of the emitting surface above the base configured to allow the emitted light to pass therethrough.

17. The lighting device of claim 10, wherein the at least one light source includes a plurality of light sources configured to emit light in different spectrums.

18. The lighting device of claim 10, further comprising:

a substantially planar circuit board configured to control activation of the at least one light source, and to at least partially surround a power source for the lighting device.

19. The lighting device of claim 10, wherein the switching mechanism is disposed on a concavity of the housing, the concavity having a diameter of approximately 1.0 inches or less.

20. The lighting device of claim 10, wherein the switching mechanism includes a plurality of switching elements.

21. The lighting device of claim 20, wherein the switching mechanism is configured to require simultaneous activation of at least two of the plurality of switching elements in order to change an emitted light from the first spectrum to the second spectrum.

22. The lighting device of claim 20, wherein the device is further configured to emit light only in the first spectrum when initially turned on, and to change the emitted light to the second spectrum, while the device is turned on, based on simultaneous activation of at least two of the plurality of switching elements.

23. The lighting device of claim 20, wherein the plurality of switching elements includes a pair of opposing pressure switches, and a spectrum switch, the spectrum switch configured to activate the changing of an emitted light from the first spectrum to the second spectrum only when the opposing pressure switches are both depressed.

24. A multi-spectrum lighting device comprising:

a housing;

at least one light source, the at least one light source configured to emit light in at least a first spectrum and a second spectrum;

a switching mechanism including a plurality of switching elements; and a feedback mechanism;

wherein, the switching mechanism is configured to turn the lighting device on and off, and to change an emitted light from the first spectrum to the second spectrum, the feedback mechanism is configured to provide a tactile feedback for at least one of when the device is turned on, when the device is turned off, and when a spectrum of emitted light is changed, and wherein the tactile feedback is provided by a motor within the housing, and can be felt through the housing.

* * * * *